US010832503B2

(12) United States Patent
Hu et al.

(10) Patent No.: US 10,832,503 B2
(45) Date of Patent: Nov. 10, 2020

(54) METHOD AND APPARATUS TO MONITOR AN ON-VEHICLE FLUIDIC SUBSYSTEM

(71) Applicant: GM Global Technology Operations LLC, Detroit, MI (US)

(72) Inventors: Yao Hu, Sterling Heights, MI (US); Atul Nagose, Royal Oak, MI (US); Thomas L. Grime, Toronto (CA); Faez Yahya, Milford, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 161 days.

(21) Appl. No.: 16/107,074

(22) Filed: Aug. 21, 2018

(65) Prior Publication Data

US 2020/0066066 A1 Feb. 27, 2020

(51) Int. Cl.

| | |
|---|---|
| ***G07C 5/08*** | (2006.01) |
| ***F02D 41/22*** | (2006.01) |
| ***G07C 5/00*** | (2006.01) |

(52) U.S. Cl.

CPC ..... *G07C 5/0808* (2013.01); *F02D 41/22* (2013.01); *G07C 5/006* (2013.01); *G07C 5/0825* (2013.01); *F02D 2041/224* (2013.01)

(58) Field of Classification Search

CPC .... G07C 5/0808; G07C 5/0825; G07C 5/006; F02D 41/22; F02D 2041/224; F02D 2041/1416; F02D 41/3854; F02D 2200/0602; F02D 2041/2027; F02D 2041/2058; F02D 41/3082; B60R 16/0231; B60R 16/08

USPC ..... 701/31.8, 34.4

See application file for complete search history.

(56) References Cited

U.S. PATENT DOCUMENTS

| | | | | |
|---|---|---|---|---|
| 2008/0161989 | A1* | 7/2008 | Breed | B60J 10/00 701/31.4 |
| 2013/0213123 | A1* | 8/2013 | Ghoneim | F02D 41/22 73/114.41 |
| 2016/0217628 | A1* | 7/2016 | Ghoneim | G05B 23/0245 |

* cited by examiner

*Primary Examiner* — Nadeem Odeh
(74) *Attorney, Agent, or Firm* — Quinn IP Law

(57) ABSTRACT

A fluidic subsystem disposed on a vehicle includes an electric motor, a motor driver, and a fluidic pump that is disposed in a fluidic circuit that is monitored by a pressure sensor. A controller includes an instruction set that is executable to dynamically observe operation of the fluidic subsystem, from which it determines a plurality of observed parameters associated with the operation of the fluidic subsystem and a plurality of estimated parameters associated with the fluidic subsystem. A plurality of fault isolation parameters are determined based upon the observed parameters and the estimated parameters, and a fault in the fluidic subsystem is isolated based upon the fault isolation parameters. The isolated fault is communicated via the controller.

18 Claims, 3 Drawing Sheets

METHOD AND APPARATUS TO MONITOR AN ON-VEHICLE FLUIDIC SUBSYSTEM

INTRODUCTION

Vehicles may benefit from on-board monitoring systems that are configured to detect occurrence of a fault or another indication of a need for service and/or vehicle maintenance.

SUMMARY

A fluidic subsystem disposed on a vehicle includes an electric motor that is electrically connected to a motor driver and rotatably connected to a fluidic pump that is disposed in a fluidic circuit, which is monitored by a pressure sensor. A controller is in communication with the electric motor, the motor driver and the fluidic circuit. The controller includes an instruction set that is executable to dynamically observe operation of the fluidic subsystem, from which it determines a plurality of observed parameters associated with the operation of the fluidic subsystem and a plurality of estimated parameters associated with the fluidic subsystem. A plurality of fault isolation parameters is determined based upon the observed parameters and the estimated parameters, and a fault in the fluidic subsystem is isolated based upon the fault isolation parameters. The isolated fault is communicated via the controller.

An aspect of the disclosure includes determining a plurality of operating parameters associated with operation of the fluidic subsystem, including determining a DC voltage level, an observed pulsewidth-modulated (PWM) duty cycle to the motor driver, a DC current, an observed motor speed of the electric motor, an observed fluidic pressure, and a fluidic flowrate in the fluidic subsystem.

Another aspect of the disclosure includes determining a DC-equivalent resistance for the electric motor based upon the DC voltage level, the PWM duty cycle, the observed motor speed and the observed DC current.

Another aspect of the disclosure includes determining a plurality of estimated parameters associated with the fluidic subsystem, which includes determining an estimated current, an estimated PWM duty cycle, and an estimated fluidic flowrate based upon the observed motor speed and the observed fluidic pressure.

Another aspect of the disclosure includes determining a plurality of estimated parameters associated with the fluidic subsystem, which includes determining an estimated motor speed based upon the observed DC voltage level, the observed PWM duty cycle, and the observed DC current.

Another aspect of the disclosure includes determining a plurality of fault isolation parameters which includes determining a speed ratio based upon the estimated motor speed and the observed motor speed.

Another aspect of the disclosure includes determining a plurality of fault isolation parameters, which includes determining a current ratio based upon the estimated current, the observed DC current, and the observed PWM duty cycle.

Another aspect of the disclosure includes determining a plurality of fault isolation parameters which includes determining a PWM ratio based upon the estimated PWM duty cycle and the observed PWM duty cycle.

Another aspect of the disclosure includes determining a plurality of fault isolation parameters which includes determining a flow ratio and a flow error based upon the estimated fluidic flowrate and the observed fluidic flowrate.

Another aspect of the disclosure includes determining a plurality of fault isolation parameters which includes determining a zero speed ratio based upon the observed motor speed, wherein the zero speed ratio is based upon a percentage of the observed motor speed samples that are at zero speed.

Another aspect of the disclosure includes determining a plurality of fault isolation parameters, including a DC-equivalent resistance, a current ratio, a PWM ratio, a speed error, a speed ratio, a zero speed ratio, a flow variation, a flow ratio term and a flow error term.

Another aspect of the disclosure includes isolating to a fault associated with the electric motor electrically connected to the motor driver based upon the DC-equivalent resistance, the PWM ratio, the speed error, and the speed ratio.

Another aspect of the disclosure includes isolating to a fault associated with the electric motor electrically connected to the motor driver based upon the DC-equivalent resistance, the PWM ratio, the speed error, the speed ratio, the zero speed ratio, the flow ratio term and the flow error term.

Another aspect of the disclosure includes isolating to a fault associated with the fluidic pump based upon the flow ratio term.

Another aspect of the disclosure includes isolating to a fault associated with the pressure sensor based upon the current ratio, the PWM ratio, the flow ratio term and the flow error term.

Another aspect of the disclosure includes isolating to a fault associated with the pressure sensor based upon the current ratio, the PWM ratio, and the flow ratio term.

Another aspect of the disclosure includes communicating, via the controller, the isolated fault to a malfunction indicator lamp Another aspect of the disclosure includes communicating, via the controller, the isolated fault to an off-board controller.

The above features and advantages, and other features and advantages, of the present teachings are readily apparent from the following detailed description of some of the best modes and other embodiments for carrying out the present teachings, as defined in the appended claims, when taken in connection with the accompanying drawings.

BRIEF DESCRIPTION OF THE DRAWINGS

One or more embodiments will now be described, by way of example, with reference to the accompanying drawings, as follows.

FIG. 3-1 graphically shows a first pump characterization curve that is associated with operation of an embodiment of the fluidic subsystem that is described with reference to FIG. 1, including a magnitude of electrical current that is required to operate the fluidic pump in relation to pump speed and fluidic pressure, in accordance with the disclosure.

FIG. 3-2 graphically shows a second pump characterization curve that is associated with operation of an embodiment of the fluidic subsystem that is described with reference to FIG. 1, including a magnitude of fluidic flow that is produced by the fluidic pump in relation to pump speed and fluidic pressure, in accordance with the disclosure.

FIG. 3-3 graphically shows a third pump characterization curve that is associated with operation of an embodiment of the fluidic subsystem that is described with reference to FIG. 1, including a pulsewidth-modulated (PWM) duty cycle for controlling the electric machine in relation to pump speed and fluidic pressure, in accordance with the disclosure.

The appended drawings are not necessarily to scale, and present a somewhat simplified representation of various preferred features of the present disclosure as disclosed herein, including, for example, specific dimensions, orientations, locations, and shapes. Details associated with such features will be determined in part by the particular intended application and use environment.

DETAILED DESCRIPTION

The components of the disclosed embodiments, as described and illustrated herein, may be arranged and designed in a variety of different configurations. Thus, the following detailed description is not intended to limit the scope of the disclosure, as claimed, but is merely representative of possible embodiments thereof. In addition, while numerous specific details are set forth in the following description in order to provide a thorough understanding of the embodiments disclosed herein, some embodiments can be practiced without some of these details. Moreover, for the purpose of clarity, technical material that is understood in the related art has not been described in detail in order to avoid unnecessarily obscuring the disclosure. Furthermore, the disclosure, as illustrated and described herein, may be practiced in the absence of an element that is not specifically disclosed herein.

Figure 1:
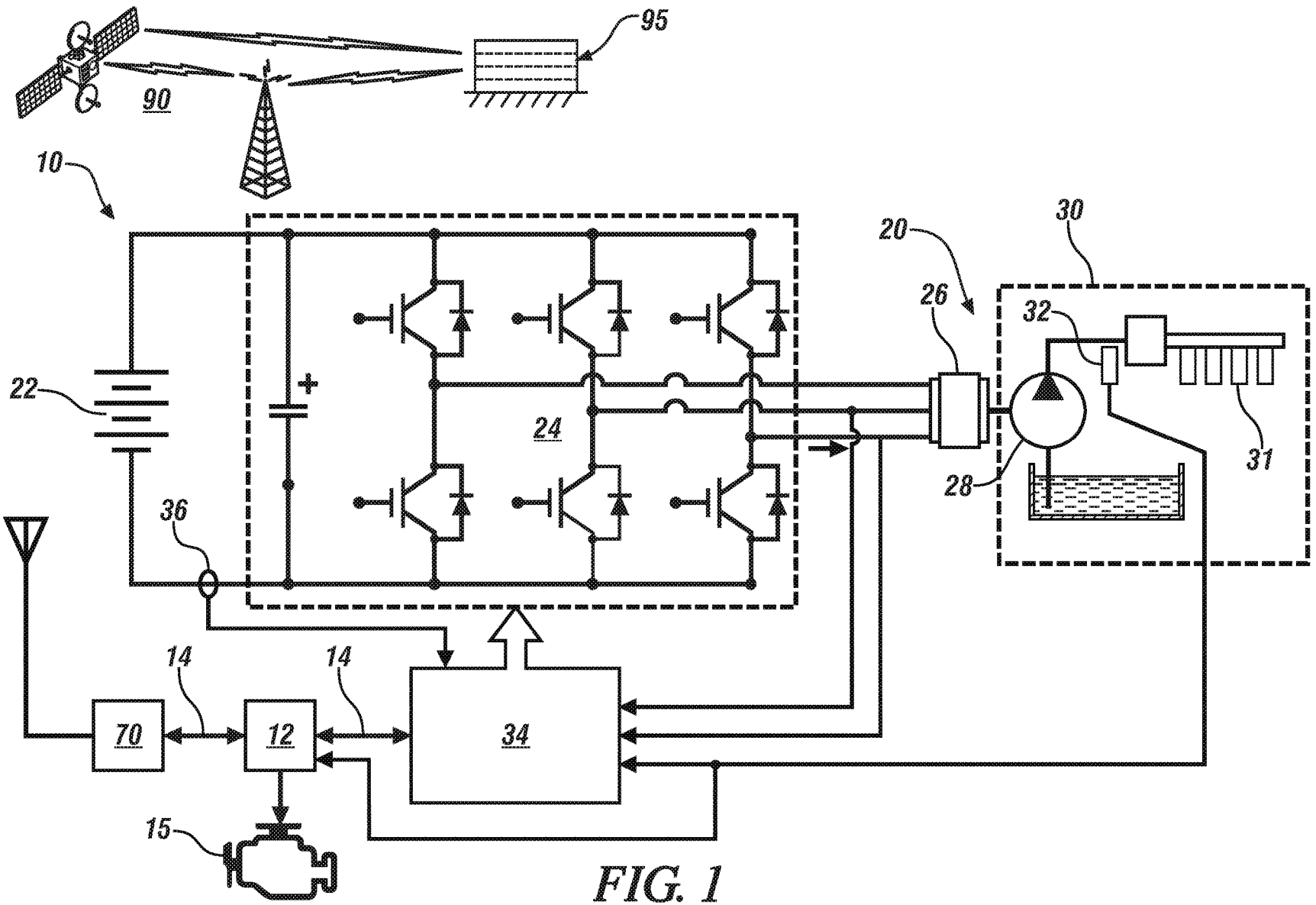
FIG. 1 schematically shows a fluidic subsystem disposed on a vehicle, which includes an electric motor that is coupled to a fluidic pump, wherein the fluidic pump is disposed in a fluidic circuit, in accordance with the disclosure.

Referring to the drawings, wherein like reference numerals correspond to like or similar components throughout the several Figures, FIG. 1, consistent with embodiments disclosed herein, schematically shows a fluidic subsystem 10 that is disposed on a vehicle. The fluidic subsystem 10 includes a pumping device 20 that includes an electric motor 26 that is coupled to a fluidic pump 28, wherein the fluidic pump 28 includes a housing and impeller that are disposed to pump fluid in a fluidic circuit 30 of the vehicle (not shown). The vehicle may be configured, by way of non-limiting examples, as a passenger vehicle, a light-duty or heavy-duty truck, a utility vehicle, an agricultural vehicle, an industrial/warehouse vehicle, or a recreational off-road vehicle. Other vehicles may include airships and watercraft.

The fluidic circuit 30 may be an on-vehicle fluidic circuit, including, e.g., a low-pressure fluidic circuit that is disposed to supply pressurized fuel to a high-pressure returnless fuel injection system 31 of an internal combustion engine (not shown), as shown. A pressure sensor 32 is disposed in the fluidic circuit 30 and is configured to monitor in-circuit fluidic pressure, which it communicates to a motor controller 34 and/or alternatively, to a system controller 12. Alternatively, the fluidic circuit 30 may be a power-steering fluid system, an engine cooling system, a transmission cooling system, etc.

The fluidic pump 28 includes a rotatable impeller that is coupled to an output shaft of an electric machine 26, and may be configured as a positive displacement device, a centrifugal device, or another pump element.

In one embodiment, the electric machine 26 is a three-phase brushless DC electric motor. Electric power originating from a DC power source 22 is supplied to the electric machine 26 via a motor driver 24 and its associated motor controller 34. In one embodiment, the motor driver 24 is an inverter that includes a plurality of controllable switches, e.g., IGBTs, and the motor controller 34 is configured to control the switches of the motor driver 24, which converts the DC power from the DC power source 22 to AC power that is supplied to the electric machine 26. A current sensor 36 may be arranged to monitor current flow between the DC power source 22 and the motor driver 24 on the power bus that electrically couples the motor driver 24 and the DC power source 22, and provides DC current feedback to the motor controller 34. The motor controller 34 is in communication with the system controller 12, which monitors operation of various other on-vehicle systems and generates commands to operate the motor controller 34 to control the electric machine 26 to operate the pump 28 to pump fluid through the fluidic circuit 30 based upon operator commands and other operating conditions. The system controller 12 communicates with some form of vehicle information center, such as a dashboard, that includes a malfunction indicator lamp (MIL) 15, which can be illuminated by the controller 12 in the event a fault is detected. The system controller 12 also communicates with other on-vehicle controllers, e.g., a telematics device 70, via the communication link 14.

This arrangement of the elements of the fluidic subsystem 10 is illustrative. In one embodiment, the fluidic pump 28 and electric machine 26 are stand-alone devices, and the motor driver 24 and motor controller 34 are physically integrated into the system controller 12 with electrical connection therebetween via electrical cables. Alternatively, the motor driver 24 and motor controller 34 can be physically integrated into the electric machine 26, which is coupled to the fluidic pump 28, and the motor controller 34 communicates with the system controller 12 via the communication link 14.

Operating parameters associated with the fluidic system 10 that can be observed by the system controller 12 and/or the motor controller 34 include, in one embodiment, the voltage level of the DC power source 22, a pulsewidth-modulated (PWM) duty cycle output from the controller 34 to control the switches of the motor driver 24, DC current levels from the current sensor 36, rotational speed of the fluidic pump 28, fluidic pressure from the pressure sensor 32, and fluidic flowrate, which is determined as described herein.

The term "controller" and related terms such as control module, module, control, control unit, processor and similar terms refer to one or various combinations of Application Specific Integrated Circuit(s) (ASIC), electronic circuit(s), central processing unit(s), e.g., microprocessor(s) and associated non-transitory memory component(s) in the form of memory and storage devices (read only, programmable read only, random access, hard drive, etc.). The non-transitory memory component is capable of storing machine-readable instructions in the form of one or more software or firmware programs or routines, combinational logic circuit(s), input/output circuit(s) and devices, signal conditioning and buffer circuitry and other components that can be accessed by one or more processors to provide a described functionality. Input/output circuit(s) and devices include analog/digital converters and related devices that monitor inputs from sensors, with such inputs monitored at a preset sampling frequency or in response to a triggering event. Software, firmware, programs, instructions, control routines, code, algorithms and similar terms mean controller-executable instruction sets including calibrations and look-up tables. Each controller executes control routine(s) to provide desired functions. Routines may be executed at regular intervals, for example each 100 microseconds during ongoing operation. Alternatively, routines may be executed in response to occurrence of a triggering event. The term 'model' refers to a processor-based or processor-executable code and associated calibration that simulates a physical existence of a device or a physical process. The terms 'dynamic' and 'dynamically' describe steps or processes that are executed in real-time and are characterized by monitoring or otherwise determining states of operating parameters and regularly or periodically updating the states of the operating parameters during execution of a routine or between iterations of execution of the routine. The terms "calibration", "calibrate", and related terms refer to a result or a process that compares an actual or standard measurement associated with a device with a perceived or observed measurement or a commanded position. A calibration as described herein can be reduced to a storable parametric table, a plurality of executable equations or another suitable form.

Communication between controllers, and communication between controllers, actuators and/or sensors may be accomplished using a direct wired point-to-point link, a networked communication bus link, a wireless link or another suitable communication link, and is indicated by line 14. Communication includes exchanging data signals in suitable form, including, for example, electrical signals via a conductive medium, electro-magnetic signals via air, optical signals via optical waveguides, and the like. The data signals may include discrete, analog or digitized analog signals representing inputs from sensors, actuator commands, and communication between controllers. The term "signal" refers to a physically discernible indicator that conveys information, and may be a suitable waveform (e.g., electrical, optical, magnetic, mechanical or electro-magnetic), such as DC, AC, sinusoidal-wave, triangular-wave, square-wave, vibration, and the like, that is capable of traveling through a medium. A parameter is defined as a measurable quantity that represents a physical property of a device or other element that is discernible using one or more sensors and/or a physical model. A parameter can have a discrete value, e.g., either "1" or "0", or can be infinitely variable in value.

The telematics device 70 includes a wireless telematics communication system capable of extra-vehicle communications, including communicating with a communication network system 90 having wireless and wired communication capabilities. The telematics device 70 is capable of extra-vehicle communications that includes short-range vehicle-to-vehicle (V2V) communication. Alternatively or in addition, the telematics device 70 has a wireless telematics communication system capable of short-range wireless communication to a handheld device, e.g., a cell phone, a satellite phone or another telephonic device. In one embodiment the handheld device is loaded with a software application that includes a wireless protocol to communicate with the telematics device 70. The handheld device is disposed to execute extra-vehicle communication, including communicating with an off-board server 95 via the communication network 90. Alternatively or in addition, the telematics device 70 executes extra-vehicle communication directly by communicating with the off-board server 95 via the communication network 90.

Faults may occur in the fluidic subsystem 10 that affect the ability of the fluidic subsystem 10 to deliver pressurized fluid at a desired pressure and a desired flowrate. Such faults may be associated with either the fluidic pump 28, the electric machine 26, or the motor driver 24 and motor controller 34. Fault isolation to one of the fluidic pump 28, the electric machine 26, or the motor driver 24 and motor controller 34 has been difficult to achieve due to absence of relevant parameters and parametric analysis.

As described herein, a method is provided to detect and isolate a fault in the fluidic subsystem 10 by determining a set of fault isolation parameters based upon observed parameters and estimated parameters. As employed herein, the term "observed" refers to parameters that are capable of being sensed by a sensor or are commands to actuators. The observed parameters include, in one embodiment, voltage level of the DC power source 22, a pulsewidth-modulated (PWM) duty cycle output from the controller 34 to control the switches of the motor driver 24, DC current levels from the current sensor 36, rotational speed of the fluidic pump 28, fluidic pressure from the pressure sensor 32, and a fluidic flowrate in the fluidic circuit 30. As employed herein, the term "estimated" refers to parameters that are capable of being determined based upon observed parameters employing relationships, calibrations and predetermined equations. The estimated parameters are described herein. A plurality of fault isolation parameters can be determined based upon the observed parameters and the estimated parameters. The fault isolation parameters can include, in one embodiment, a current error ratio, a PWM error ratio, a flow error ratio, a speed error, a speed error ratio and a zero speed ratio. A fault in the fluidic subsystem can be isolated based upon the fault isolation parameters and communicated via the controller 12 to the MIL 15 and/or to the off-board server 95, wherein such a fault can be isolated to a fault associated with the pressure sensor 32, a fault associated with the fluidic pump 28, or a fault associated with the motor driver 24 and the electric motor 26. Details are described with reference to FIG. 2.

Figure 2:
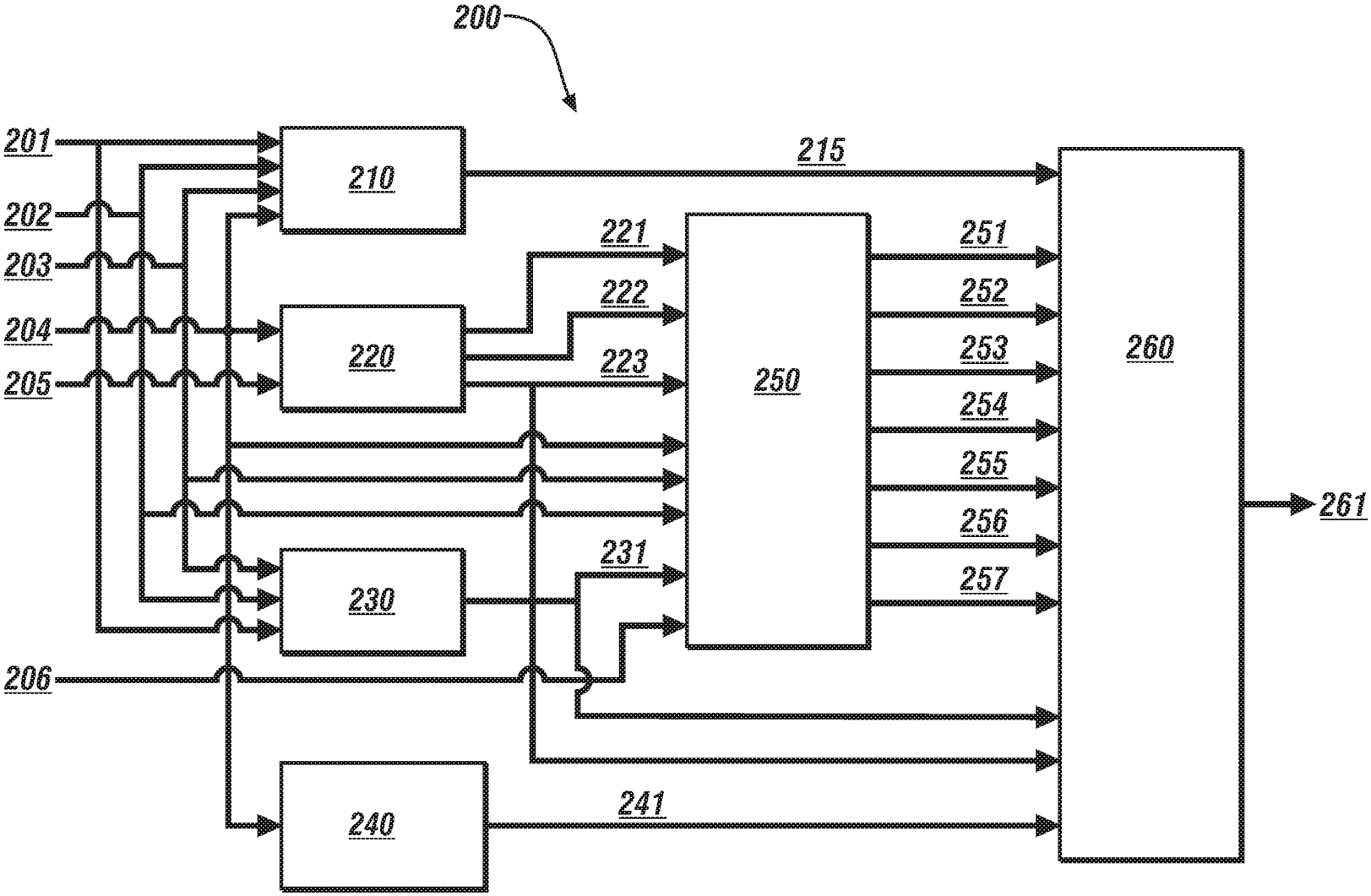
FIG. 2 schematically illustrates a control routine for monitoring and isolating a fault on an embodiment of the fluidic subsystem that is described with reference to FIG. 1, in accordance with the disclosure.

FIG. 2 schematically illustrates a control routine 200 for monitoring and isolating a fault on an embodiment of the fluidic subsystem 10 that is described with reference to FIG. 1. The control routine 200 is executable as one or more control routines and predetermined calibration tables, and includes the steps of dynamically monitoring parameters associated with operation of the fluidic subsystem to determine the observed parameters and the estimated parameters, and a set of fault isolation parameters are determined based upon the first and second sets of parameters.

The observed parameters associated with operation of the fluidic subsystem 10 include voltage level of the DC power source 22 ($U_{DC}$) 201, pulsewidth-modulated duty cycle for the switches of the motor driver 24 (PWM) 202, DC current ($I_{DC}$) 203, rotational speed of the rotor of the electric machine 26 (ω) 204, fluidic pressure (Pressure) 205, and fluidic flowrate (Flow) 206.

The voltage level of the DC power source 22 ($U_{DC}$), the pulsewidth-modulated duty cycle for the switches of the motor driver 24 (PWM), the DC current ($I_{DC}$), and the rotational speed of the rotor of the electric machine 26 (ω) are provided as inputs into an analytical resistance model 210, which estimates a DC-equivalent motor resistance ($R_{DC}$) 215 for the electric machine 26 based thereon. The analytical resistance model 210 is composed of a resistance estimator, as follows. When the electric machine 26 is configured as three-phase, brushless DC motor, instantaneous value for motor resistance (R) 215 for a three-phase brushless DC motor can be determined in accordance with the following relationship:

$$\tfrac{2}{3}U_A-\tfrac{1}{3}U_B-\tfrac{1}{3}U_C=RI_A+(\tfrac{2}{3}K_{eA}-\tfrac{1}{3}K_{eB}-\tfrac{1}{3}K_{eC})\omega+L\,dI_A/dt$$

$$\tfrac{2}{3}U_B-\tfrac{1}{3}U_C-\tfrac{1}{3}U_A=RI_B+(\tfrac{2}{3}K_{eB}-\tfrac{1}{3}K_{eC}-\tfrac{1}{3}K_{eA})\omega+L\,dI_B/dt \quad [1]$$

wherein:

the $K_e$ terms each represent a phase-specific back-emf coefficient,

A, B and C represent phases of the three-phase brushless DC motor; and

L represents a phase-specific inductance.

A DC-based instantaneous value can be determined in accordance with the following relationship:

$$U_+ - U_- = 2(RI_+ + K_e\omega + LdI_+/dt) \quad [2]$$

wherein:

+ and − represent the activated phases, and $U_+ - U_-$ represents voltage potential between the activated phases.

A DC-equivalent model can be determined in accordance with the following relationship:

$$\text{mean}(U_+ - U_-) = 2R\ \text{mean}(I_+) + 2K_e\ \text{mean}(\omega) \text{ and}$$

$$U_{DC}*\text{PWM} = 2R\ \text{mean}(I_{DC})/\text{PWM} + 2K_e\ \text{mean}(\omega). \quad [3]$$

Employing the relationships of Eqs. 1, 2 and 3, a value for DC-equivalent motor resistance $R_{DC}$ 215 can be estimated based upon an analytical model of the brushless DC motor that takes into account the voltage level, resistance, inductance and back-emf for each of the three phases of the three-phase motor. The DC-equivalent motor resistance $R_{DC}$ 215 may be determined employing a least-square estimation employing the relationship described in Eq. 4 based upon the parameters of DC power source 22 ($U_{DC}$) 201, the pulsewidth-modulated duty cycle for the switches of the motor driver 24 (PWM) 202, the DC current ($I_{DC}$) 203, and the rotational speed of the rotor of the electric machine 26 (ω) 204:

$$R_{DC} = (U_{DC}*\text{PWM} - 2K_e\ \text{mean}(\omega))/(\text{mean}(I_{DC})/\text{PWM}) \quad [4]$$

wherein:

$K_e$ is a back-emf coefficient, mean($I_{DC}$) is an average value for the DC current, and mean(ω) is an average value for the rotational speed.

The rotational speed of the rotor of the electric machine 26 (ω) 204 and the fluidic pressure (Pressure) 205 are provided as inputs to a characterization table 220 to estimate a current ($I_{est}$) 221, estimate a pulsewidth-modulated duty cycle for the switches of the motor driver 24 ($PWM_{est}$) 222, and estimate a fluidic flowrate ($Flow_{est}$) 223.

Figures 1, 3:
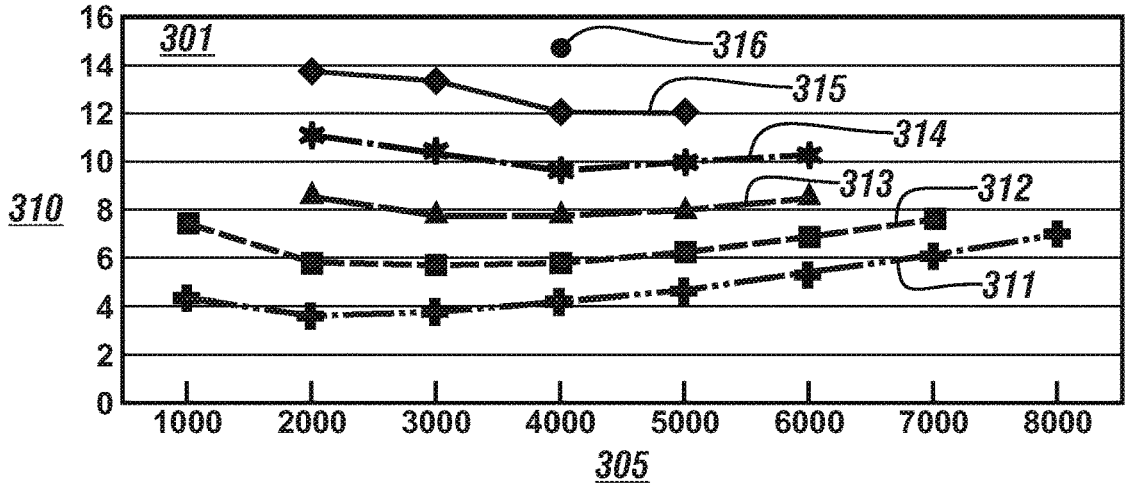
Figures 2, 3:
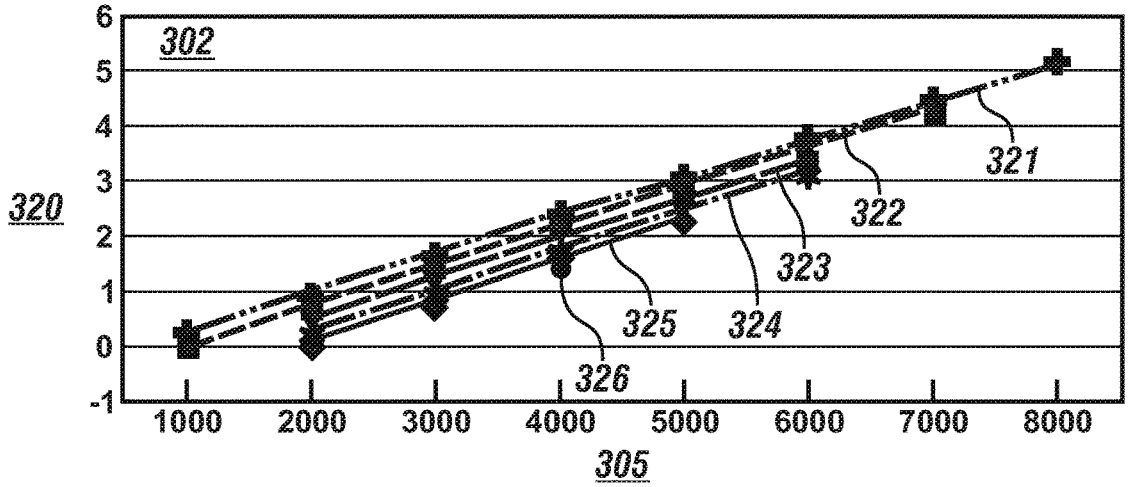
Figure 3:
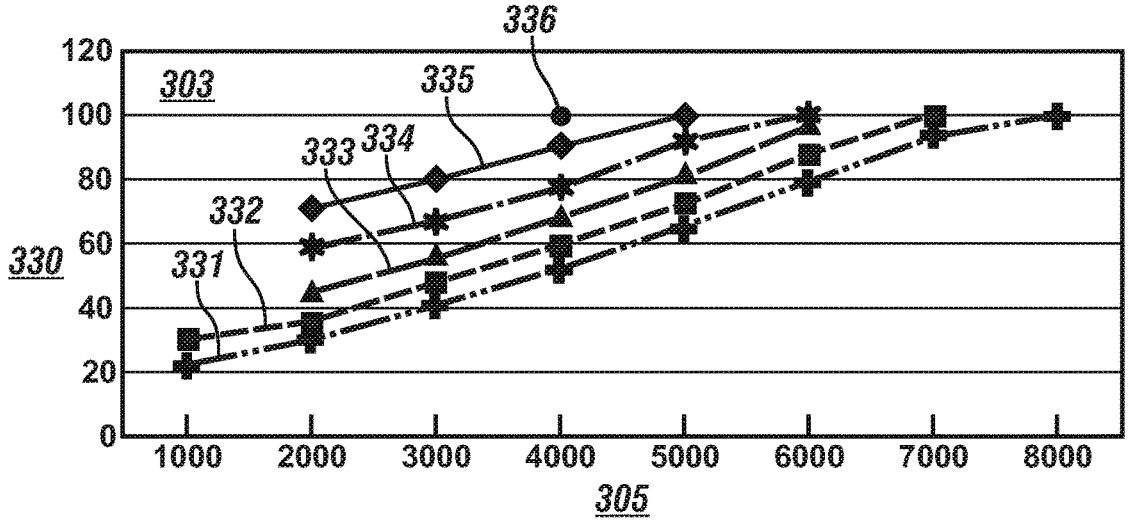

FIGS. 3-1, 3-2 and 3-3 graphically show examples of the characterization table 220 that are based upon rotational speed of the rotor of the electric machine 26 (ω) and the fluidic pressure (Pressure). The graphically shown examples of the characterization tables 220 provide ideal values that are achieved by operating a sample of the electric machine 26 and the fluidic pump 28 under a prescribed set of ambient circumstances, e.g., temperature, pressure, etc., wherein the samples of the electric machine 26 and fluidic pump 28 have been manufactured according to their respective dimensional specifications, and are operating in accordance with respective design and performance specifications, i.e., are known good parts and are absent any fault.

FIG. 3-1 graphically shows a first pump characterization curve 301 that is associated with operation of an embodiment of the fluidic pump 28 and the electric machine 26. The first pump characterization curve 301 depicts a magnitude of electrical current that is required to operate the fluidic pump in relation to pump speed and fluidic pressure. In one embodiment, the magnitude of electrical current is a mean value for the DC current. The first pump characterization curve 301 includes a magnitude of estimated motor current ($I_{est}$) 310 on the vertical axis in relation to pump speed 305 (rpm) on the horizontal axis. The results include a plurality of data curves, including a first curve 311 showing current in relation to pump speed at a fluidic pressure of 100 kPa, a second curve 312 showing current in relation to pump speed at a fluidic pressure of 200 kPa, a third curve 313 showing current in relation to pump speed at a fluidic pressure of 300 kPa, a fourth curve 314 showing current in relation to pump speed at a fluidic pressure of 400 kPa, a fifth curve 315 showing current in relation to pump speed at a fluidic pressure of 500 kPa, and a sixth curve 316 showing current in relation to pump speed at a fluidic pressure of 600 kPa. The first pump characterization curve 301 can be employed to determine a value for the estimated motor current ($I_{est}$) 310 based upon pump speed and fluidic pressure. The first pump characterization curve 301 can be represented in tabular form or as equations that can be stored in non-volatile memory devices for interrogation during operation.

FIG. 3-2 graphically shows a second pump characterization curve 302 that is associated with operation of an embodiment of the fluidic pump 28 and the electric machine 26. The second pump characterization curve 302 depicts a magnitude of fluidic flow that is produced by the fluidic pump in relation to pump speed and fluidic pressure. In one embodiment, the magnitude of fluidic flow is a mean value. The second pump characterization curve 302 includes a magnitude of fluidic flow (Flow) 320 on the vertical axis in relation to pump speed 305 (rpm) on the horizontal axis. Flow may be volume-based or mass-based. The results include a plurality of data curves, including a first curve 321 showing flow in relation to pump speed at a fluidic pressure of 100 kPa, a second curve 322 showing flow in relation to pump speed at a fluidic pressure of 200 kPa, a third curve 323 showing flow in relation to pump speed at a fluidic pressure of 300 kPa, a fourth curve 324 showing flow in relation to pump speed at a fluidic pressure of 400 kPa, a fifth curve 325 showing flow in relation to pump speed at a fluidic pressure of 500 kPa, and a sixth curve 326 showing flow in relation to pump speed at a fluidic pressure of 600 kPa. The second pump characterization curve 302 can be employed to determine a value for the flow 320 based upon pump speed and fluidic pressure. The second pump characterization curve 302 can be represented in tabular form or as equations that can be stored in non-volatile memory devices for interrogation during operation.

FIG. 3-3 graphically shows a third pump characterization curve 303 that is associated with operation of an embodiment of the fluidic pump 28 and the electric machine 26. The third pump characterization curve 303 depicts a PWM duty cycle for controlling the electric machine 26 in relation to pump speed and fluidic pressure. In one embodiment, the PWM duty cycle is a mean value. The third pump characterization curve 303 includes a PWM duty cycle 330 on the vertical axis in relation to pump speed 305 (rpm) on the horizontal axis. The results include a plurality of data curves, including a first curve 331 showing the PWM duty cycle in relation to pump speed at a fluidic pressure of 100 kPa, a second curve 332 showing the PWM duty cycle in relation to pump speed at a fluidic pressure of 200 kPa, a third curve 333 showing the PWM duty cycle in relation to pump speed at a fluidic pressure of 300 kPa, a fourth curve 334 showing the PWM duty cycle in relation to pump speed at a fluidic pressure of 400 kPa, a fifth curve 335 showing the PWM duty cycle in relation to pump speed at a fluidic pressure of 500 kPa, and a sixth curve 336 showing the PWM duty cycle in relation to pump speed at a fluidic pressure of 600 kPa. The third pump characterization curve 303 can be employed to determine a value for the PWM duty cycle 330 based upon pump speed and fluidic pressure. The third pump characterization curve 303 can be represented in tabular form or as equations that can be stored in non-volatile memory devices for interrogation during operation.

The voltage level 210 of the DC power source 22, the pulsewidth-modulated duty cycle 202 for the switches of the motor driver 24, and the DC current 203 are provided as inputs into a speed observer model 230. The speed observer model 230 can take the form of the following equation, which can be reduced to algorithmic code that can be recursively executed to estimate rotational speed 231 for the electric machine 26

$$\begin{bmatrix} \hat{i}(k+1) \\ -\frac{K_e}{L_a}\hat{\omega}(k+1) \end{bmatrix} = \begin{bmatrix} 1 & T \\ 0 & 1 \end{bmatrix} \left( \begin{bmatrix} \hat{i}(k) \\ -\frac{K_e}{L_a}\hat{\omega}(k) \end{bmatrix} + \begin{bmatrix} L_1 \\ L_2 \end{bmatrix} [i(k) - \hat{i}(k)] \right) + \begin{bmatrix} \frac{T}{L_a} \\ 0 \end{bmatrix} [V_m(k) - R_a i(k)] \quad [5]$$

wherein:

$V_m$ represents $U_{DC}$*PWM, and i=mean($I_{DC}$)/PWM.

Eq. 5 can be recursively executed to determine the speed observer $\hat{\omega}$ and estimated current $\hat{i}$ in accordance with the following relationship:

$$\hat{\omega}(k+1) = \hat{\omega}(k) - [i(k) - \hat{i}(k)]\frac{L_a}{K_e}L_2$$

$$\hat{i}(k+1) = -\hat{\omega}(k)\frac{TK_e}{L_a} + [V_m(k) - R_a i(k)]\frac{T}{L_a} + L_1 i(k) + \hat{i}(k)(1 - L_1).$$

The rotational speed of the rotor 204 of the electric machine 26 is provided to analytical block 240 to determine a zero-speed ratio 241. The analytical block 240 evaluates each sample of the rotational speed 204, including counting the quantity of samples that have a value of zero speed, counting the total quantity of samples, and calculating the zero-speed ratio 241 based thereon.

The pulsewidth-modulated duty cycle for the switches of the motor driver 24 202, the DC current ($I_{DC}$) 203, the pump speed (w) 204, the flowrate (Flow) 206, the estimated current ($I_{est}$) 221, the estimated pulsewidth-modulated (PWM) duty cycle for the switches of the motor driver 24 222, the estimated fluidic flowrate ($Flow_{est}$) 223, and the estimated pump speed ($\hat{\omega}$) 231 are provided as inputs to a key signal generation routine 250 that are employed to determine a plurality of fault isolation parameters, which can be employed by a fault isolation routine 260 to isolate a fault in the fluidic subsystem 10.

The fault isolation parameters include a current ratio ($ratio_I$) 251, which is determined in accordance with:

$$ratio_I = \frac{I_{est}}{\text{mean}(I_{DC})/PWM}.$$

The fault isolation parameters include the PWM ratio ($ratio_{PWM}$) 252, which is determined in accordance with:

$ratio_{PWM}$=$PWM_{est}$/PWM.

The fault isolation parameters include the estimated pump speed ($\hat{\omega}$) 231, which is determined as described herein employing the speed observer model 230.

The fault isolation parameters include a speed ratio ($ratio_\omega$) 253, which is determined in accordance with:

$ratio_\omega$=$\omega/\hat{\omega}$.

The fault isolation parameters include a speed error ($error_\omega$) 254, which is determined in accordance with:

$error_\omega$=$\omega-\hat{\omega}$.

The fault isolation parameters include a zero-speed ratio ($ratio_{zero_\omega}$) 241, which is determined as the percentage of speed ω data samples that are at zero speed.

The fault isolation parameters include a flow variance term ($Var_{Flow}$) 257, which is determined in accordance with:

$Var_{Flow}$=mean($Flow^2$).

The fault isolation parameters include a flow ratio ($ratio_{Flow}$) 255 and a flow error ($error_{Flow}$) 256, which are determined by a linear regression of the following equation:

$Flow_{est}$=$ratio_{Flow}$*Flow+$errorr_{Flow}$.

The foregoing fault isolation parameters are communicated to the fault isolation routine 260 to isolate a fault in the fluidic subsystem 10, wherein the faults relate to the fluidic pump 28, the electric machine 26, or the fluidic circuit 30. The fault isolation routine 260 periodically executes to evaluate each of the fault isolation parameters to determine occurrence of a fault, or absence of occurrence of a fault. This is depicted in Table 1. The symbol "↓," indicates a low value, which is determined relative to a threshold value, and the symbol "↑" indicates a high value, which is determined relative to a threshold value. This information can be employed to isolate a fault for purposes of servicing the fluidic subsystem 10. Table 1 is provided as an example to illustrate fault isolation associated with observed and estimated parameters for a specific vehicle configuration. In another vehicle having a different configuration, the behaviors of these parameters may vary from those shown in Table 1.

TABLE 1

| Fault | $R_{DC}$ | $ratio_I$ | $ratio_{PWM}$ | $error_\omega$ | $ratio_\omega$ | $ratio_{zero\omega}$ | $Var_{Flow}$ | $ratio_{Flow}$ | $error_{Flow}$ |
|---|---|---|---|---|---|---|---|---|---|
| Balanced High Resistance | ↑ | | ↓ | ↓ | ↓ | | | | |
| Unbalanced High Resistance | ↑ | | ↑ | ↓ | ↓ | ↑ | | ↓ | ↑ |
| Positive sensor Bias | | ↑ | ↑ | | | | | ↓ | |
| Negative sensor Bias | | ↓ | ↓ | | | | | ↓ | ↑ |
| Internal Leakage | | | | | | | | ↑ | |
| No Fault | | | | | | | | | |

A fault is isolated to the electric machine 26 in the form of a balanced high resistance fault when the DC-equivalent motor resistance ($R_{DC}$) 215 has a high value, relative to a threshold resistance, and the PWM ratio ($ratio_{PWM}$) 252, the speed ratio ($ratio_{\omega}$) 253 and the speed error ($error_{\omega}$) 254 have low values, relative to threshold levels.

A fault is isolated to the electric machine 26 in the form of an unbalanced high resistance fault when the DC-equivalent motor resistance ($R_{DC}$) 215 has a high value relative to a threshold resistance, the PWM ratio ($ratio_{PWM}$) 252 has a high value relative to a threshold ratio, the speed ratio ($ratio_{\omega}$) 253 and the speed error ($error_{\omega}$) 254 have low values relative to threshold levels, the zero-speed ratio ($ratio_{zero_\omega}$) 241 has a high value relative to a threshold ratio, the flow ratio ($ratio_{Flow}$) 255 has a low value relative to a threshold value, and the flow error ($error_{Flow}$) 256 has a high value relative to a threshold value.

A fault is isolated to the fluidic circuit 30, and more specifically to the pressure sensor 32 indicating a positive sensor bias when the current ratio ($ratio_I$) 251 has a high value relative to a threshold value, the PWM ratio ($ratio_{PWM}$) 252 has a high value relative to a threshold value, and the flow ratio ($ratio_{Flow}$) 255 has a low value relative to a threshold value.

A fault is isolated to the fluidic circuit 30, and more specifically to the pressure sensor 32 indicating a negative sensor bias when the current ratio ($ratio_I$) 251 has a low value relative to a threshold value, the PWM ratio ($ratio_{PWM}$) 252 has a low value relative to a threshold value, the flow ratio ($ratio_{Flow}$) 255 has a low value relative to a threshold value, and the flow error ($error_{Flow}$) 256 has a high value relative to a threshold value.

A fault is isolated to the fluidic pump 28, and more specifically to indicating an internal leakage issue when the flow ratio ($ratio_{Flow}$) 255 has a high value relative to a threshold value.

No fault is indicated under other conditions and other combinations of condition.

Referring again to FIGS. 1 and 2, the fault isolation routine 260 communicates the isolated fault or absence thereof via communication line 261 to the MIL 15 and/or the off-board server 95 via the communication network 90 via the telematics device 70.

The flowchart and block diagrams in the flow diagrams illustrate the architecture, functionality, and operation of possible implementations of systems, methods, and computer program products according to various embodiments of the present disclosure. In this regard, each block in the flowchart or block diagrams may represent a module, segment, or portion of code, which comprises one or more executable instructions for implementing the specified logical function(s). It will also be noted that each block of the block diagrams and/or flowchart illustrations, and combinations of blocks in the block diagrams and/or flowchart illustrations, may be implemented by special-purpose hardware-based systems that perform the specified functions or acts, or combinations of special-purpose hardware and computer instructions. These computer program instructions may also be stored in a computer-readable medium that can direct a controller or other programmable data processing apparatus to function in a particular manner, such that the instructions stored in the computer-readable medium produce an article of manufacture including instructions to implement the function/act specified in the flowchart and/or block diagram block or blocks.

The detailed description and the drawings or figures are supportive and descriptive of the present teachings, but the scope of the present teachings is defined solely by the claims. While some of the best modes and other embodiments for carrying out the present teachings have been described in detail, various alternative designs and embodiments exist for practicing the present teachings defined in the appended claims.

What is claimed is:

1. A method for monitoring a fluidic subsystem disposed on a vehicle, the fluidic subsystem including an electric motor electrically connected to a motor driver and rotatably connected to a fluidic pump that is disposed in a fluidic circuit that is monitored by a pressure sensor, the method comprising:

dynamically observing operation of the fluidic subsystem;

determining a plurality of observed parameters associated with the operation of the fluidic subsystem, including a direct current (DC) voltage level of the motor driver, an observed pulsewidth-modulated (PWM) duty cycle to the motor driver, a DC current flow to the motor driver, an observed motor speed of the electric motor, an observed fluidic pressure, and an observed fluidic flowrate in the fluidic subsystem;

determining a plurality of estimated parameters associated with the fluidic subsystem;

determining, via a controller, a plurality of fault isolation parameters based upon the plurality of observed parameters and the plurality of estimated parameters;

isolating a fault in the fluidic subsystem based upon the plurality of fault isolation parameters; and communicating, via the controller, the isolated fault.

2. The method of claim 1, wherein determining the plurality of observed parameters further comprises determining a DC-equivalent motor resistance for the electric motor based upon the DC voltage level, the PWM duty cycle, the observed motor speed, and the observed DC current.

3. The method of claim 1, wherein the plurality of estimated parameters associated with the fluidic subsystem comprise an estimated current, an estimated PWM duty cycle, and an estimated fluidic flowrate that are determined based upon the observed motor speed and the observed fluidic pressure.

4. The method of claim 3, wherein the plurality of estimated parameters associated with the fluidic subsystem further comprise an estimated motor speed that is determined based upon the observed DC voltage level, the observed PWM duty cycle, and the observed DC current.

5. The method of claim 4, wherein determining the plurality of fault isolation parameters comprises determining a speed ratio based upon the estimated motor speed and the observed motor speed.

6. The method of claim 3, wherein determining the plurality of fault isolation parameters comprises determining a current ratio based upon the estimated current, the observed DC current, and the observed PWM duty cycle.

7. The method of claim 3, wherein determining the plurality of fault isolation parameters comprises determining a PWM ratio based upon the estimated PWM duty cycle and the observed PWM duty cycle.

8. The method of claim 3, wherein the plurality of fault isolation parameters comprise a flow ratio and a flow error that are determined based upon the estimated fluidic flowrate and the observed fluidic flowrate.

9. The method of claim 1, wherein the plurality of fault isolation parameters comprise a zero speed ratio that is determined based upon the observed motor speed, wherein the zero speed ratio is based upon a percentage of samples of the observed motor speed that are at zero speed.

10. The method of claim 1, wherein the plurality of fault isolation parameters comprise a DC-equivalent motor resistance, a current ratio, a pulsewidth-modulated (PWM) ratio, a speed error, a speed ratio, a zero speed ratio, a flow variation, a flow ratio term, and a flow error term.

11. The method of claim 10, wherein isolating the fault in the fluidic subsystem based upon the plurality of fault isolation parameters comprises isolating to a fault associated with the electric motor electrically connected to the motor driver based upon the DC-equivalent motor resistance, the PWM ratio, the speed error, and the speed ratio.

12. The method of claim 10, wherein isolating the fault in the fluidic subsystem based upon the plurality of fault isolation parameters comprises isolating to a fault associated with the electric motor electrically connected to the motor driver based upon the DC-equivalent motor resistance, the PWM ratio, the speed error, the speed ratio, the zero speed ratio, the flow ratio term, and the flow error term.

13. The method of claim 10, wherein isolating the fault in the fluidic subsystem based upon the plurality of fault isolation parameters comprises isolating to a fault associated with the fluidic pump based upon the flow ratio term.

14. The method of claim 10, wherein isolating the fault in the fluidic subsystem based upon the plurality of fault isolation parameters comprises isolating to a fault associated with the pressure sensor based upon the current ratio, the PWM ratio, the flow ratio term, and the flow error term.

15. The method of claim 10, wherein isolating the fault in the fluidic subsystem based upon the plurality of fault isolation parameters comprises isolating to a fault associated with the pressure sensor based upon the current ratio, the PWM ratio, and the flow ratio term.

16. The method of claim 1, further comprising communicating, via the controller, the isolated fault to a malfunction indicator lamp.

17. The method of claim 1, further comprising communicating, via the controller, the isolated fault to an off-board controller.

18. A fluidic subsystem disposed on a vehicle, the fluidic subsystem comprising:

an electric motor electrically connected to a motor driver and rotatably connected to a fluidic pump that is disposed in a fluidic circuit that is monitored by a pressure sensor;

a current sensor disposed to monitor direct current (DC) current supplied to the motor driver;

a controller, in communication with the motor driver, the pressure sensor and the current sensor, the controller including an instruction set that is executable to:

dynamically observe operation of the fluidic subsystem;

determine a plurality of observed parameters associated with the operation of the fluidic subsystem, including a direct current (DC) voltage level of the motor driver, an observed pulsewidth-modulated (PWM) duty cycle to the motor driver, a DC current flow to the motor driver, an observed motor speed of the electric motor, an observed fluidic pressure, an observed fluidic flow in the fluidic subsystem, and a DC-equivalent motor resistance for the electric motor that is determined based upon the DC voltage level, the PWM duty cycle, the observed motor speed, and the observed DC current;

determine a plurality of estimated parameters associated with the fluidic subsystem;

determine a plurality of fault isolation parameters based upon the plurality of observed parameters and the plurality of estimated parameters;

isolate a fault in the fluidic subsystem based upon the plurality of fault isolation parameters; and communicate the isolated fault.

* * * * *